US006648668B1

(12) United States Patent
Ko

(10) Patent No.: US 6,648,668 B1
(45) Date of Patent: Nov. 18, 2003

(54) MICRO COAXIAL CABLE CONNECTOR HAVING LATCHES FOR SECURELY ENGAGING WITH A COMPLEMENTARY CONNECTOR

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/199,713

(22) Filed: Jul. 19, 2002

(51) Int. Cl.[7] ..... H01R 13/627
(52) U.S. Cl. ..... 439/353; 439/497; 439/607
(58) Field of Search ..... 439/353, 350, 439/357, 358, 607, 610, 497, 579

(56) References Cited

U.S. PATENT DOCUMENTS

| | | | | |
|---|---|---|---|---|
| 5,941,726 A | * | 8/1999 | Koegel et al. | 439/358 |
| 6,093,057 A | * | 7/2000 | Lok | 439/607 |
| 6,146,210 A | * | 11/2000 | Cha et al. | 439/680 |
| D444,130 S | | 6/2001 | Hayashi et al. | |
| 6,273,753 B1 | | 8/2001 | Ko | |
| 6,305,978 B1 | | 10/2001 | Ko et al. | |
| 6,338,652 B1 | | 1/2002 | Ko | |
| D456,777 S | | 5/2002 | Igarashi | |
| D456,779 S | | 5/2002 | Igarashi | |
| D456,780 S | | 5/2002 | Igarashi | |
| D457,138 S | | 5/2002 | Igarashi | |
| 6,454,592 B2 | * | 9/2002 | Takagi | 439/378 |
| 6,561,699 B1 | * | 5/2003 | De Marchi | 385/58 |

* cited by examiner

*Primary Examiner*—Hien Vu
(74) *Attorney, Agent, or Firm*—Wei Te Chung

(57) ABSTRACT

An electrical connector comprises an insulative housing (1), a contact set (2) assembled into the housing, a shield (3) enclosing the housing, and a pair of latch devices (4) assembled to the housing. The housing comprises a base portion (11), a plurality of passageways (111) defined in the base portion, a pair of retention portions (14) at a pair of ends thereof. The contact set comprises an insulative insert (21), a plurality of signal and grounding contacts (22) received in the insert, and a grounding bar (23) assembled in the insert. The signal and grounding contacts extend into the passageways. The grounding bar has a plurality of grounding fingers (234) electrically connecting the grounding contacts. The pair of latch devices is assembled to the retention portions and each latch device comprises a latch portion (41) having an engaging portion (414) for latching with a mating connector.

13 Claims, 9 Drawing Sheets

MICRO COAXIAL CABLE CONNECTOR HAVING LATCHES FOR SECURELY ENGAGING WITH A COMPLEMENTARY CONNECTOR

BACKGROUND OF THE INVENTION

1. Field of the Invention

The present invention relates to a micro coaxial cable connector used in liquid crystal display (LCD) application, and particularly to such connector having improved latches for reliably securing the connector to a complementary connector mounted in an LCD panel.

2. Description of Related Art

U.S. Pat. Nos. 6,305,978 B1, 6,273,753 B1, 6,338,652 B1, D456,779 S, D456,780 S, D456,777 S, D457,138 S, and D444,130 S disclose low profiled micro coaxial cable connectors. This type connector is used to transmit signals between a mother board in a base of a notebook computer and an LCD panel of the notebook computer. The micro coaxial cable connector must securely engage with a complementary connector in the LCD panel, because the LCD panel is frequently pivoted relative to the base of the notebook computer. In the old design, the micro coaxial cable connector has no locking device for latching with the complementary connector when the two connectors are connected together. This cannot ensure a reliably secure connection between the two connectors, whereby the cable connector may be unintentionally disconnected from the complementary connector, and the signal transmission between the two connectors is broken. It is desired to provide a new micro coaxial cable connector having locking device for securely latching with a complementary connector in an LCD panel.

SUMMARY OF THE INVENTION

Accordingly, one object of the present invention is to provide a micro coaxial cable connector having latches for securely engaging with a complementary connector.

In order to achieve the object set forth, an electrical connector, comprising an insulative housing, a contact set received in the housing, a shield enclosing the housing, and a pair of latch portions assembled to the housing for locking with a mating connector. The housing comprises a base portion, a plurality of passageways defined in the base portion, and a pair of retention portions at a pair of ends of the base portion. A contact set assembled to a rear end of the housing and comprises an insulative insert, a plurality of signal and grounding contacts received in the insert, and a grounding bar assembled in the insert. The signal and grounding contacts extend forwardly into the passageways of the housing. The grounding bar has a plurality of grounding fingers electrically connecting the grounding contacts. The pair of latch portions is assembled to the retention portions of the housing and each latch portion has an engaging portion for latching with a mating connector.

Other objects, advantages and novel features of the invention will become more apparent from the following detailed description when taken in conjunction with the accompanying drawings.

DETAILED DESCRIPTION OF THE INVENTION

Figure 1:
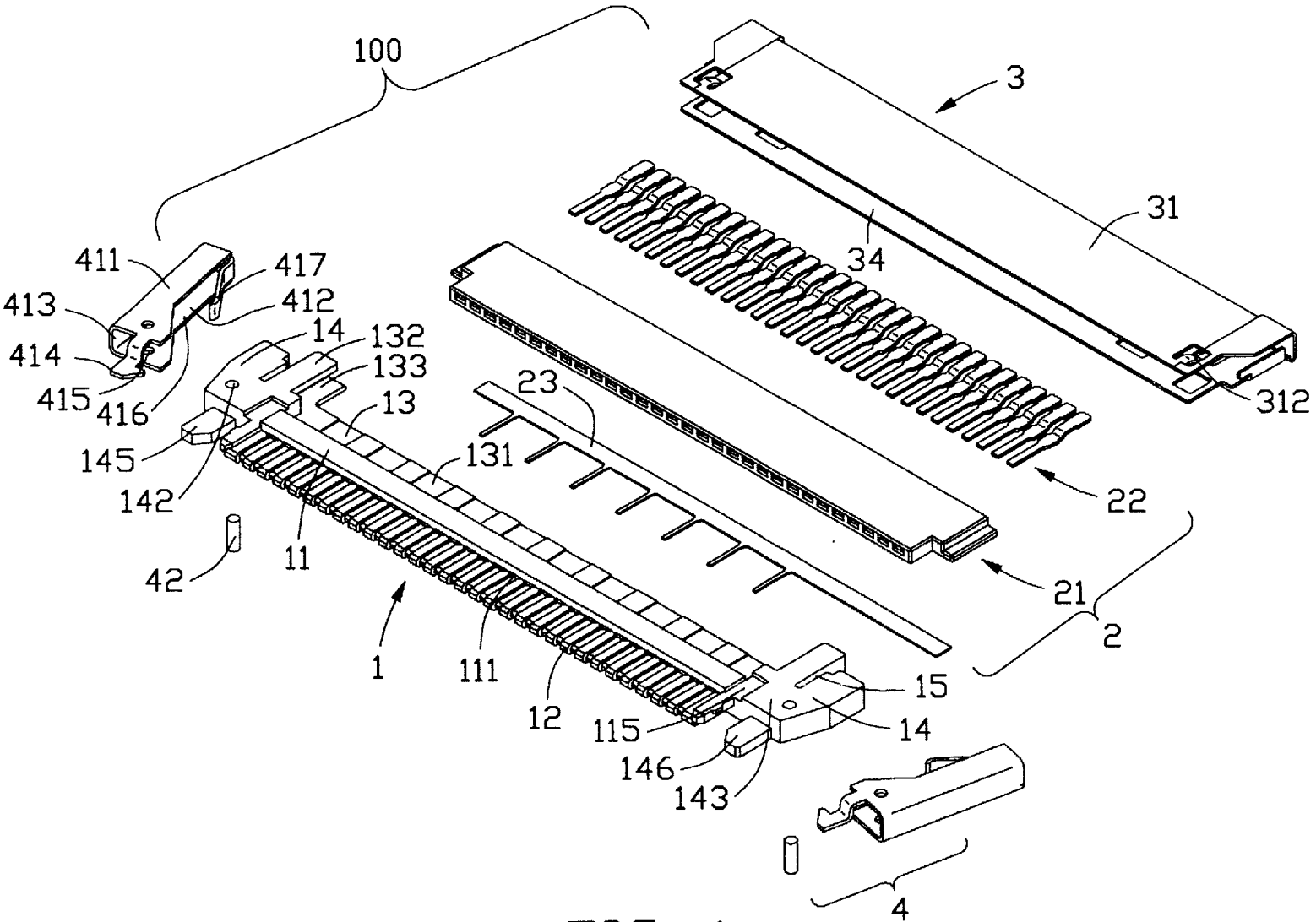
FIG. 1 is an exploded view of a micro coaxial cable connector in accordance with the present invention.
Figure 2:
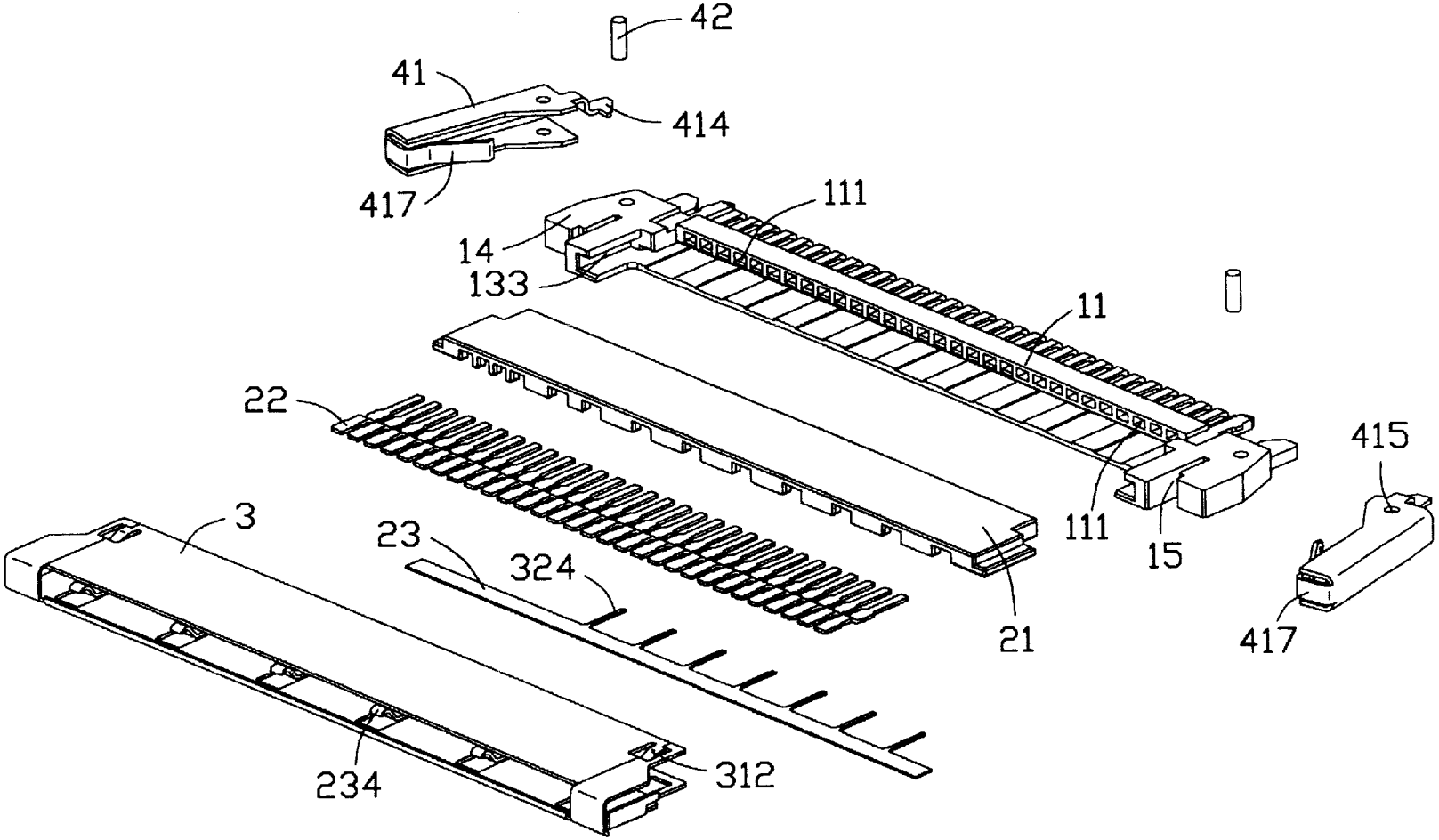
FIG. 2 is a view similar to FIG. 1, from a different aspect.
Figure 3:
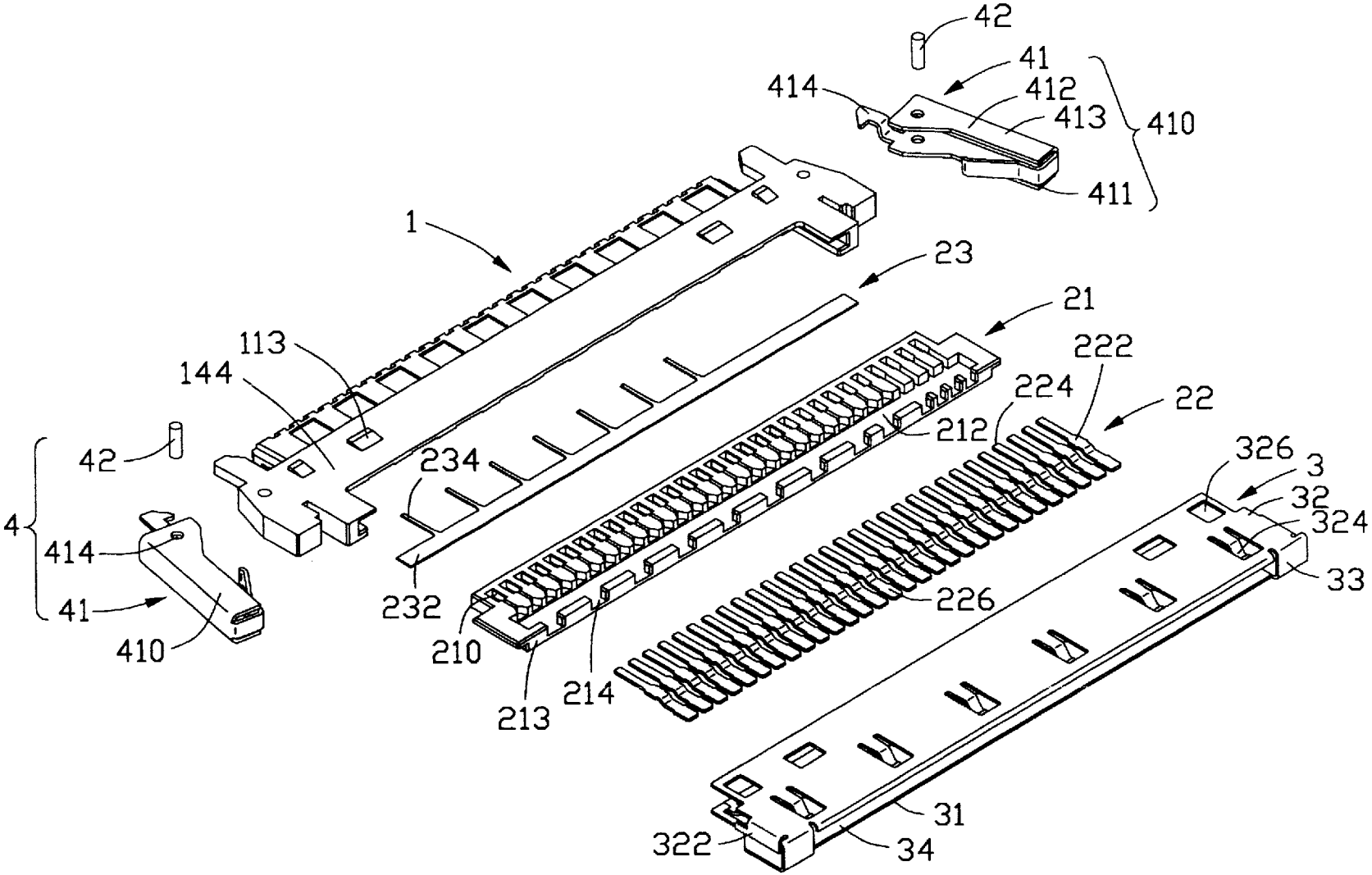
FIG. 3 is a view similar to FIG. 1, from a further different aspect.

Referring to FIGS. 1, 2 and 3, a micro coaxial cable connector 100 of the present invention comprises an elongate insulative housing 1, a contact set 2, a shield 3, and a pair of latch devices 4.

The insulative housing 1 comprises an elongate base portion 11, a tongue portion 12 extending forwardly from the base portion 11, a rear portion 13 at a rear end of the base portion 11, a pair of retention portions 14 formed on lateral ends of the base portion 11. The base portion 11 and the tongue portion 12 together define a plurality of passageways 111 from the rear end of the base portion 11 to a front end of the tongue portion 12. The rear portion 13 comprises an elongate plate 131 extending rearwardly from the base portion 11, a pair of receiving sections 132 formed on lateral ends of the elongate plate 131. Each of the receiving sections 132 defines a receiving channel 133 in an inner side thereof. A gap 15 is defined between each retention portion 14 and a corresponding receiving section 132. A pair of through holes 142 is respectively defined in the pair of retention portions 14 from upper surfaces 143 to lower surfaces 144 of the retention portions 14. A pair of guiding posts 145 extends forwardly from front ends of the retention portions 14 and each guiding post 145 has a flat upper surface 146. A plurality of protrusions 113 is formed on a bottom face of the base portion 11. A pair of recesses 115 is defined in an upper surface face of the base portion 11 adjacent to the retention portions 14.

The contact set 2 comprises an insulative insert 21, a plurality of signal and grounding contacts 22, and a grounding bar 23.

The insulative insert 21 defines a plurality of channels 210 adjacent to a front end thereof, a receiving groove 212 adjacent to a rear end thereof. The channels 210 communicate with the receiving groove 212. The channels 210 are extended in a front-to-rear direction. The groove 212 is laterally extended. A plurality of slots 214 extends through a rear face 213 of the insert 21 and communicates with the receiving groove 212. The slots 214 are used to allow a plurality of wires of a cable (not shown) extending therethrough into the receiving groove 212 and the channels 210.

The signal and grounding contacts 22 have the same structure; each contact 22 comprises a retention section 222, a mating section 224 extending forwardly from the retention section 222, and a connecting section 226 extending rearwardly from the retention section 222. The mating sections 224 are for electrically engaging with the complementary connector. The connecting sections 226 are for electrically connecting with the wires of the cable.

The grounding bar 23 comprises an elongate, laterally extending main portion 232 and a plurality of grounding fingers 234 extending forwardly from the main portion 232.

The shield 3 comprises an upper plate 31, a lower plate 32, and a pair of connecting portions 33 connecting rear portions of the upper plate 31 and the lower plate 32. A receiving space 34 is defined between the upper and the lower plates 31 and 32. A pair of side portions 322 extends from a pair of lateral ends of the lower plate 32 to the upper plate 31. A plurality of resilient tabs 324 extends from the lower plate 32 into the receiving space 34 and a plurality of apertures 326 is defined in the lower plate 32. A pair of resilient bars 312 extends from the upper plate 31 into the receiving space 34.

Each latch device 4 comprises a latch portion 41 and a pivot 42. Each latch portion 41 comprises a U-shaped body portion 410 which has a top plate 411, a bottom plate 412, and a side plate connecting side edges of the top and bottom plates 411, 412. The top plate 411, the bottom plate 412, and the side plate 413 together define a receiving cavity 416. The top plate 411 has an engaging portion 414 in a configuration of a claw extending forwardly from a front end thereof. A pair of retaining holes 415 is defined through the top and bottom plates 411 and 412 of the body portion 410. A spring tab 417 extends forwardly from a rear end of the side plate 413 of the body portion 410 and in a direction away from the side plate 413.

Figure 4:
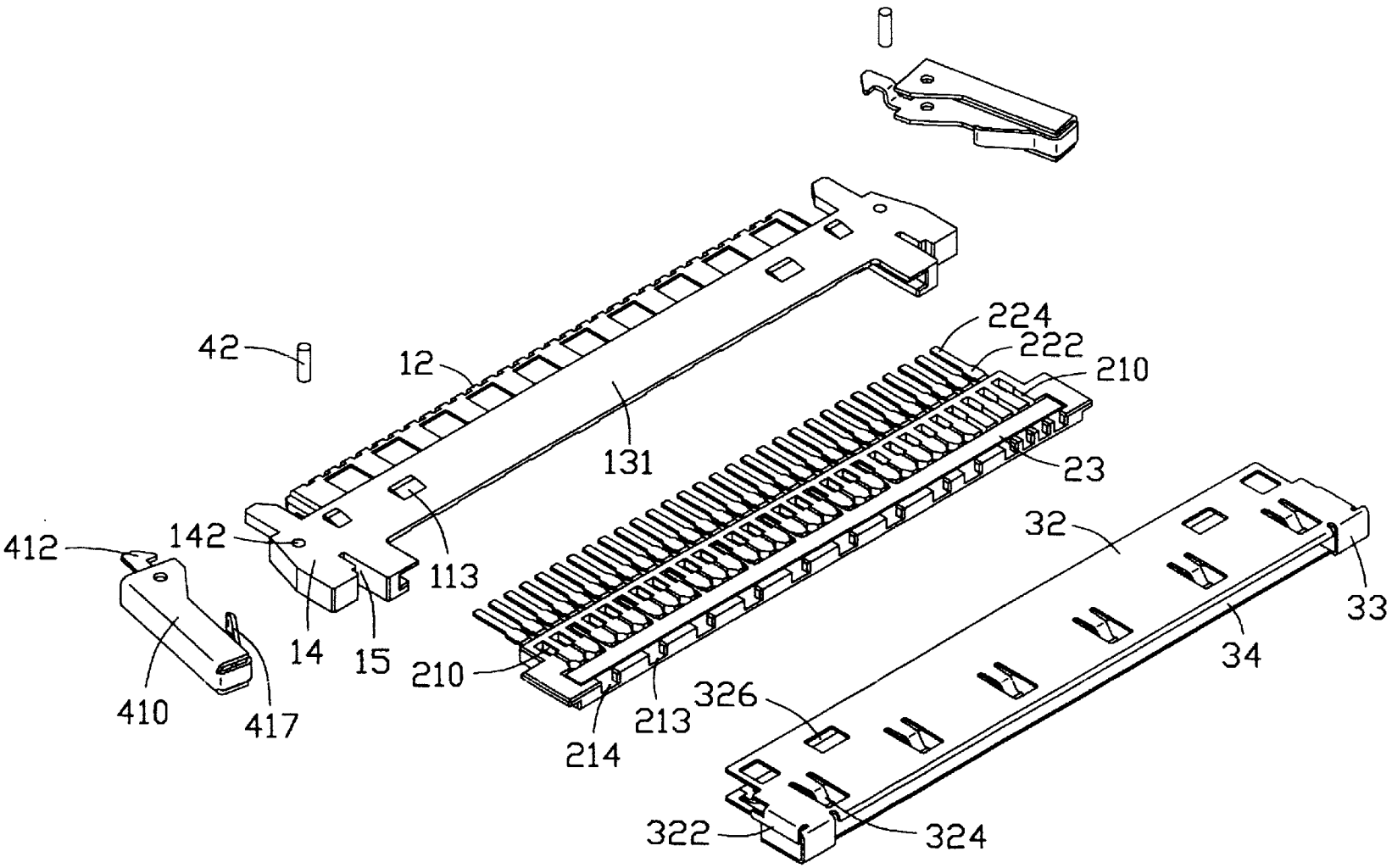
FIG. 4 is a partly assembled view of the micro coaxial cable connector of FIG. 3.

Referring to FIG. 4, in assembly, the signal and grounding contacts 22 are respectively inserted into the channels 210 with the connecting sections 226 of the contacts 22 received in the channels 210, and the retention sections 222 and the mating sections 224 extending forwardly beyond the a front face of the insert 21. The grounding bar 23 is inserted into the receiving groove 212 with the grounding fingers 234 extending into corresponding channels 210 to electrically contact the grounding contacts of the contacts 22. Therefore, the contact set 2 is assembled together.

Figure 5:
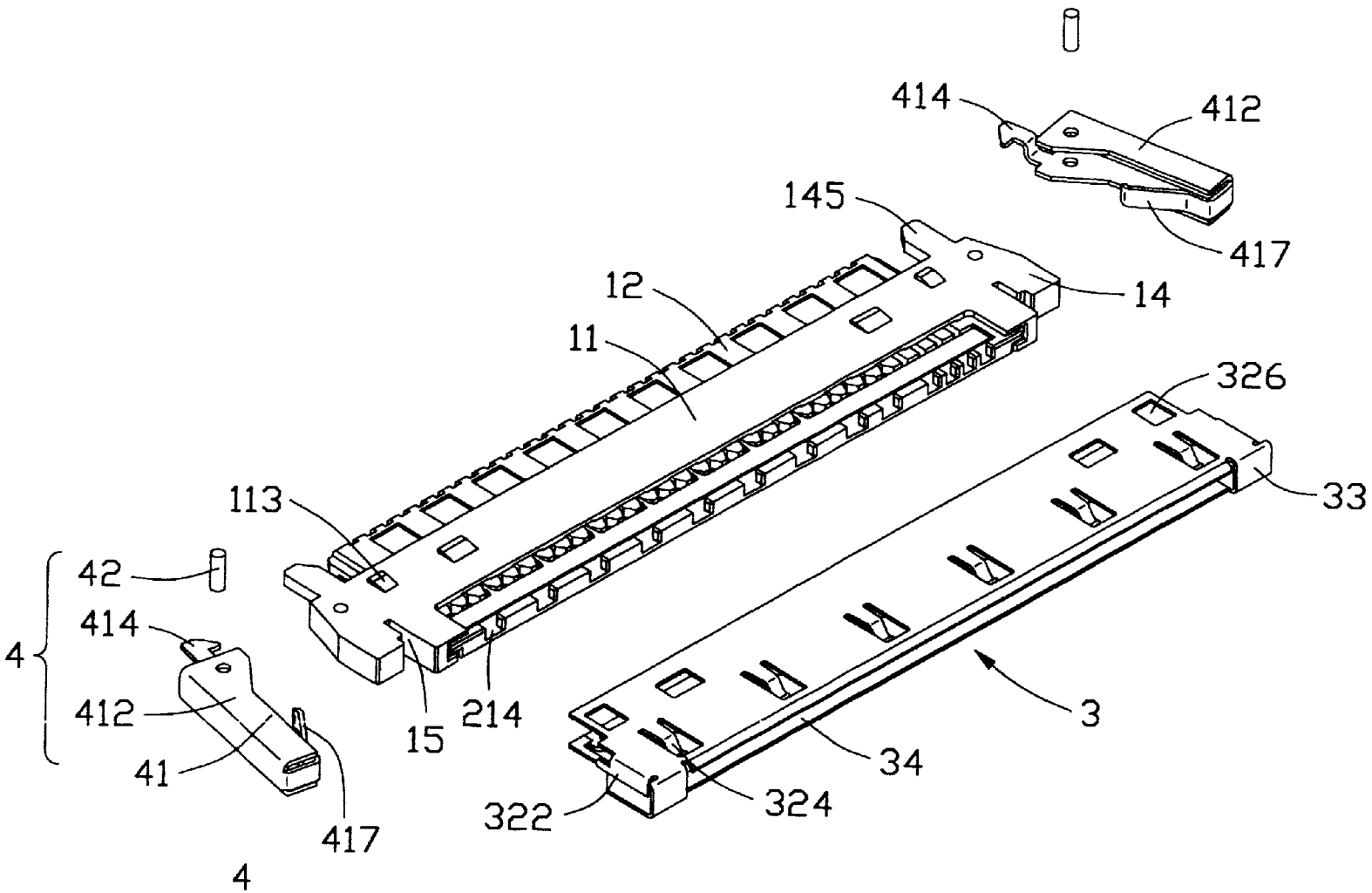
FIG. 5 is a view similar to FIG. 4, with more components of the connector being assembled together.
Figure 6:
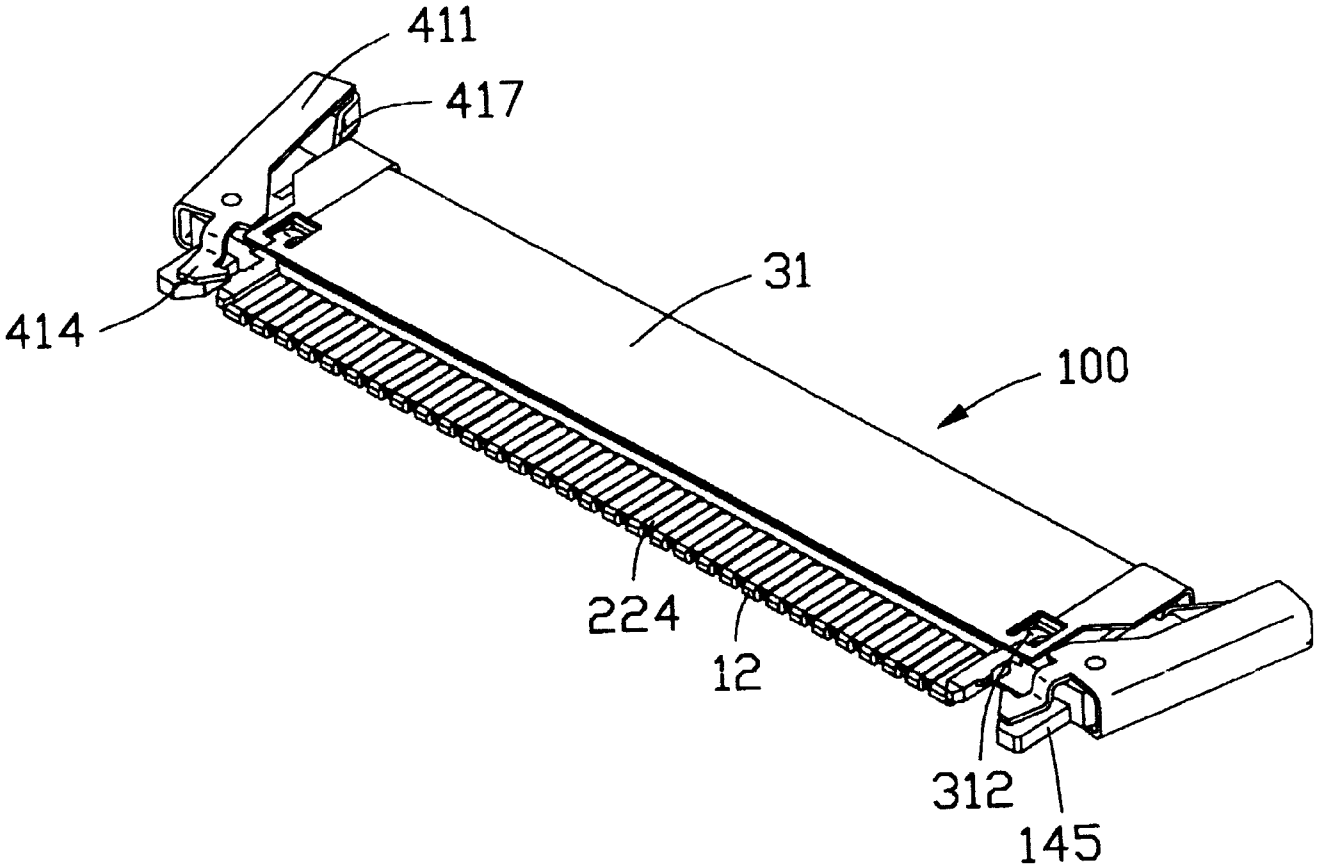
FIG. 6 is an assembled view of the micro coaxial cable connector of FIG. 1.
Figure 7:
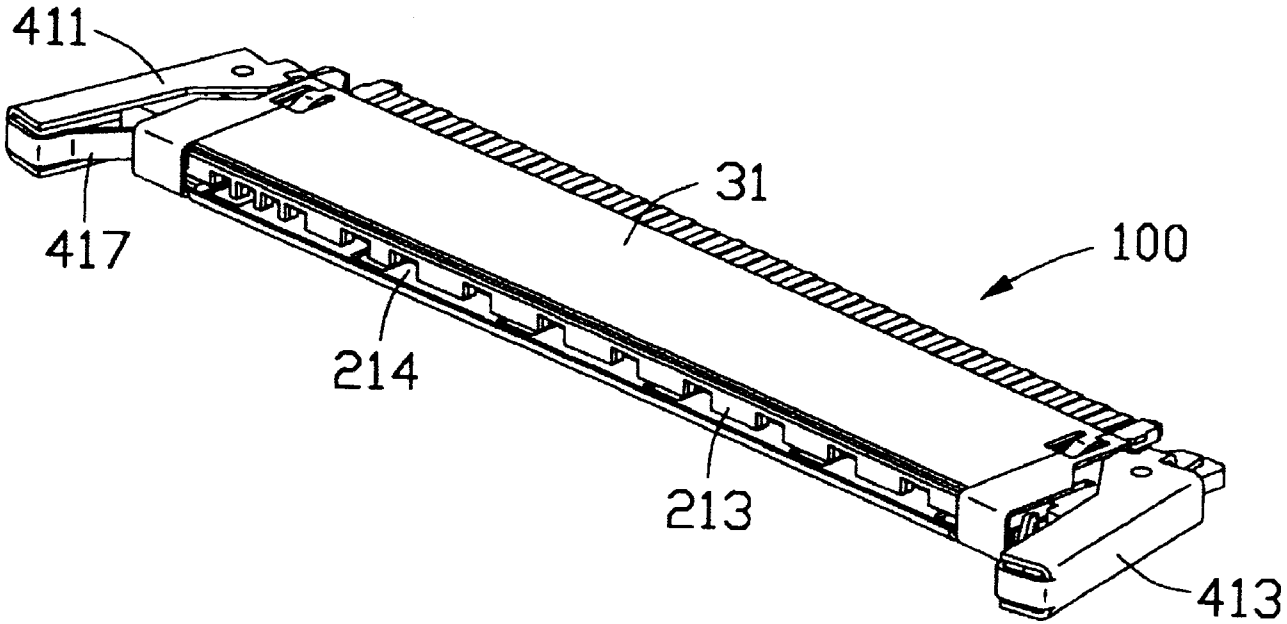
FIG. 7 is an assembled view of the micro coaxial cable connector of FIG. 2.
Figure 8:
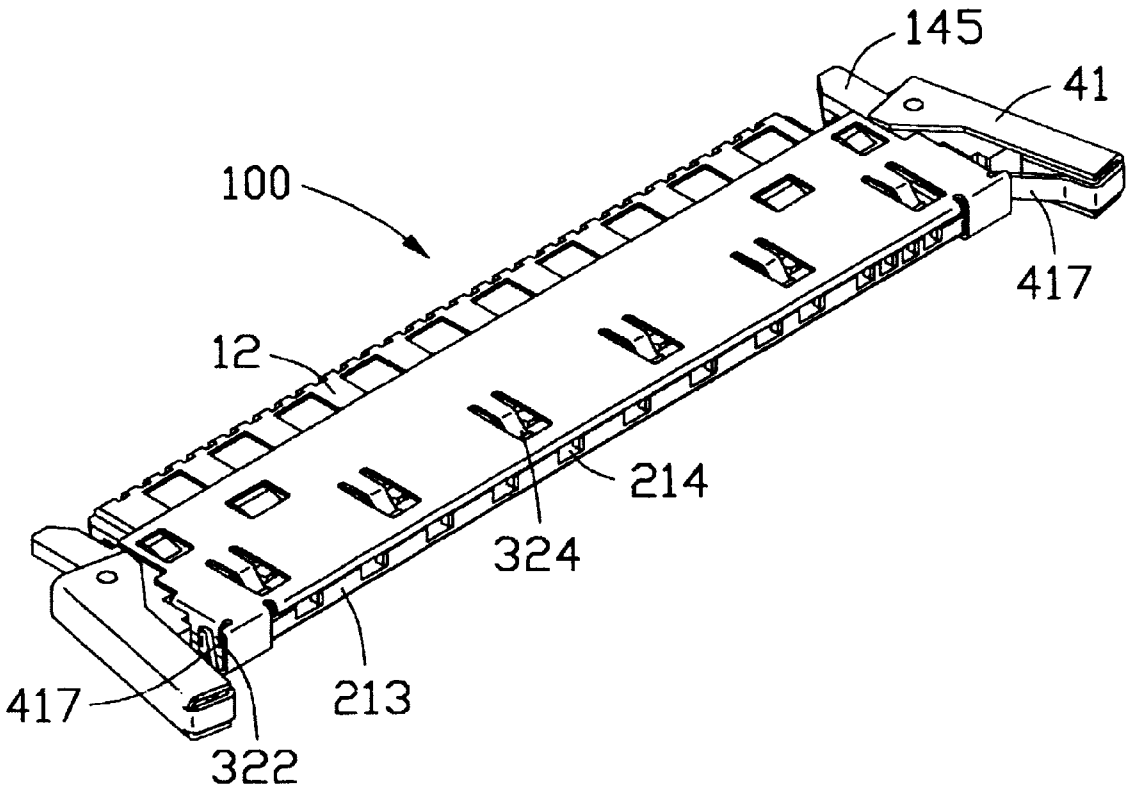
FIG. 8 is an assembled view of the micro coaxial cable connector of FIG. 3.
Figure 9:
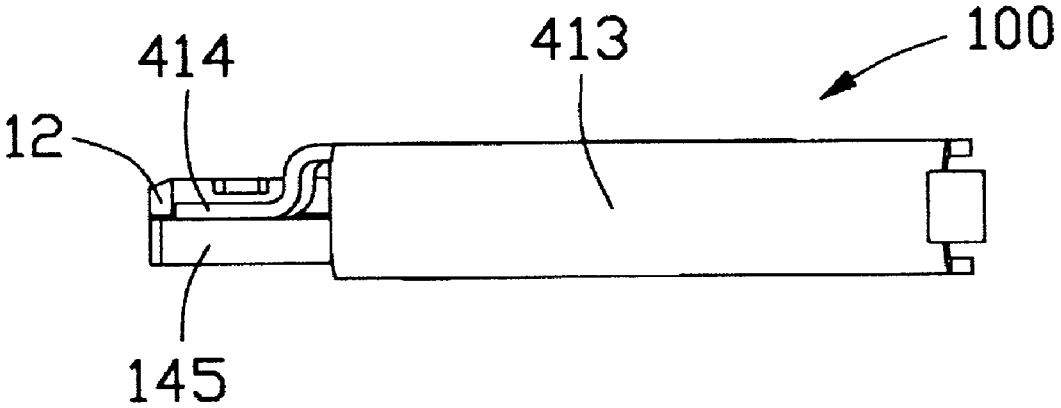
FIG. 9 is a side view of the micro coaxial cable connector of FIG. 1.

Referring to FIGS. 4 and 5, the contact set 2 is assembled to the elongate plate 131 of the rear portion 13 of the insulative housing 1 with lateral ends of the contact set 2 received in the receiving channels 133 of the receiving sections 132, respectively, and the retention sections 222 and the mating sections 224 of the contacts 22 extending into the passageways 111 of the housing 1, wherein the retention sections have an interferential fit with the housing 1.

Referring to FIG. 5, the housing 1 is assembled into the receiving space 34 of the shield 3 with the plurality of protrusions 113 fitted into the apertures 326, the resilient tabs 324 extending into the receiving groove 212 and engaging with the grounding bar 23, and the resilient bars 312 engaging in the recesses 115 of the base portion 11 of the housing 1. Thus, the insulative housing 1, the contact set 2 and the shield 3 are assembled together.

Referring to FIGS. 5 to 9, the latch devices 4 are respectively assembled to the retention portions 14 of the housing 1. The retention portions 14 are respectively inserted into the receiving cavities 416 of the latch portions 41, and the pivots 42 are extended through the retaining holes 415 of the body portions 410 and the through holes 142 of the housing 1 to pivotably connect the latch devices 4 to the retention portions 14, respectively. The engaging portions 414 abut against the flat upper surfaces 146 of the guiding posts 145, and the spring tabs 417 extend into the gaps 15 and resiliently abut against the side portions 322 of the shield 3. Accordingly, the micro coaxial cable connector 100 in accordance with the present invention is completed.

When the micro coaxial cable connector 100 engages with the complementary connector (not shown), the engaging portions 414 are extended into the complementary connector to latch therewith, whereby the connector 100 and the complementary connector are securely connected together. To separate the connector 100 from the complementary connector, rear ends of the latch devices 4 are pushed towards each other to cause the engaging portions 41 to be pivoted away from each other, whereby the latch of the connector 100 with the complementary connector is released and the connector 100 can be pulled to separate from the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an elongate insulative housing having a base portion, a plurality of passageways defined in the base portion, a pair of retention portions at a pair of ends of the base portion;

a contact set assembled to a rear end of the housing and comprising an insulative insert, a plurality of signal and grounding contacts received in the insert, and a grounding bar assembled in the insert, the signal and grounding contacts extending into the passageways of the housing, the grounding bar having a plurality of grounding fingers electrically connecting the grounding contacts; and a pair of latch portions assembled to the retention portions of the housing and each latch portion having an engaging portion for latching with a mating connector; wherein each of the latch portions has a body portion enclosing each of the retention portions of the housing and securely assembled thereon, the engaging portion extends forwardly from th body portion; wherein the connector further comprises a shield enclosing the housing; wherein the shield has a pair of side portions formed on a pair of ends thereof, each latch portion has spring tab extending from the body portion and abuts against the side portion of the shield; wherein the body portion comprises an upper plate, a bottom plate, and a side plate connecting an edge of the upper plate and an edge of the bottom plate; wherein a pair of Riding posts extends forwardly from the retention portions, the engaging portions extending from the upper plates of the latch portions abut against upper surfaces of the guiding posts.

2. The electrical connector as described in claim 1, wherein the engaging portion extends forwardly from the upper plate of the body portion.

3. The electrical connector as described in claim 1, wherein the spring tab extends from the side plate of the latch portion.

4. The electrical connector as described in claim 3, wherein the housing defines a pair of gaps from a rear end thereof, each gap locates between the base portion and the retention portion, the spring tabs are received into the gaps.

5. The electrical connector as described in claim 1, wherein a pair of through holes is defined in the retention portions, a pair of retaining holes defined in the upper and bottom plates of the body portions of the latch portions, a pair of pivots extends through the retaining holes of the body portions and the through holes of the housing to secure the latch portions to the housing.

6. The electrical connector as described in claim 1, wherein the base portion has a receiving portion at a rear end thereof and receiving the contact set therein.

7. The electrical connector as described in claim 1, wherein the housing further comprises a tongue portion extending forwardly from the base portion, the passageways are defined in the base portion and the tongue portion.

8. The electrical connector as described in claim 1, wherein the insert defines a plurality of channels at a front end thereof, the signal and grounding contacts each are partly respectively received into the channels and partly extend beyond the channels into the passageways.

9. The electrical connector as described in claim 8, wherein a receiving groove is defined in the insert adjacent to a rear end of the insert, the grounding bar is respectively received in the receiving groove.

10. The electrical connector as described in claim 9, wherein the grounding bar has a main portion received into the receiving groove and a plurality of grounding fingers extends forwardly from the main portion and is respectively received into the channels to electrically connect with the grounding contacts received into the channels.

11. The electrical connector as described in claim 1, wherein the shield further comprises an upper plate and a lower plate, a plurality of resilient tabs extends downwardly from the lower plate into the receiving groove of the insert.

12. The electrical connector as described in claim 1, wherein a plurality of grooves is defined in the lower plate, a plurality of protrusions is formed on a bottom surface of the housing and is respectively received into the grooves for preventing the housing from separating the shield.

13. The electrical connector as described in claim 1, wherein a pair of resilient tabs is formed on the upper plate of the shield, a pair of recesses is defined in an upper face of the base portion, the resilient tabs are respectively received into the recesses of the housing.

* * * * *